US010280641B2

(12) United States Patent
Kulkaski

(10) Patent No.: US 10,280,641 B2
(45) Date of Patent: May 7, 2019

(54) LIQUID CONTAINMENT POOL WALL USING POLYMER SHEETING

(71) Applicant: Bernard J. Kulkaski, Pine Grove, PA (US)

(72) Inventor: Bernard J. Kulkaski, Pine Grove, PA (US)

( * ) Notice: Subject to any disclaimer, the term of this patent is extended or adjusted under 35 U.S.C. 154(b) by 0 days.

(21) Appl. No.: 15/990,090

(22) Filed: May 25, 2018

(65) Prior Publication Data

US 2018/0363313 A1 Dec. 20, 2018

Related U.S. Application Data

(60) Provisional application No. 62/521,042, filed on Jun. 16, 2017.

(51) Int. Cl.
*E04H 4/00* (2006.01)

(52) U.S. Cl.
CPC ... *E04H 4/0018* (2013.01); *E04H 2004/0068* (2013.01)

(58) Field of Classification Search
CPC ..... E04H 4/0018; E04H 2004/0068
See application file for complete search history.

(56) References Cited

U.S. PATENT DOCUMENTS 3,486,289 A * 12/1969 Lavack ..... E04H 4/0018 29/429
3,974,605 A 8/1976 Beatty et al.
3,975,874 A 8/1976 Witte et al.
4,027,442 A 6/1977 Silverman
4,047,340 A 9/1977 Witte et al.
4,048,773 A 9/1977 Laven
4,109,324 A 8/1978 Cornelius
4,118,809 A 10/1978 Bertsch
4,124,907 A 11/1978 Laven
RE29,936 E 3/1979 Arp
4,177,614 A * 12/1979 Arp ..... E04H 4/0043 4/506
4,316,571 A 2/1982 Corna et al.
4,464,802 A 8/1984 Glonek et al.
4,566,141 A 1/1986 Mahoney
4,843,658 A * 7/1989 Hodak ..... E04H 4/0081 4/506
5,010,603 A 4/1991 Hertzog
5,791,099 A 8/1998 Duffy
5,815,853 A 10/1998 Chase
5,896,715 A 4/1999 Maupas
5,991,940 A 11/1999 Fortier
6,202,370 B1 * 3/2001 Miller ..... B28B 7/0008 52/169.14

(Continued)

*Primary Examiner* — Rodney Mintz
(74) *Attorney, Agent, or Firm* — Hilary J. Sumner

(57) ABSTRACT

A liquid containment vessel or pool having a wall constructed of thermoplastic polymers. Most pool walls are manufactured from steel or aluminum which are prone to deformation and corrosion. Polymer sheets or banding can be used to replace customary pool walls, offering a tough, strong, lightweight, corrosion resistant and easily installed material that can be manufactured from recycled plastics. When oriented, laminated, woven, corrugated, or layered, the strength of the polymer sheeting or banding increases further, allowing the present invention to be adapted for use in a variety of applications.

15 Claims, 7 Drawing Sheets

(56) References Cited

U.S. PATENT DOCUMENTS

| | | | | |
|---|---|---|---|---|
| 6,226,938 | B1 | 5/2001 | Hodak | |
| 6,839,919 | B2 * | 1/2005 | Pugliese, Jr. | E04H 4/0037 4/506 |
| 7,464,417 | B2 * | 12/2008 | Liu | E04H 4/0025 220/613 |
| 7,797,887 | B2 | 9/2010 | Maupas | |
| 8,702,030 | B1 | 4/2014 | Gilham, Jr. | |
| 8,850,773 | B2 | 10/2014 | Cohen | |
| 9,593,455 | B2 * | 3/2017 | Khamis | E04H 4/0037 |
| 10,036,173 | B2 * | 7/2018 | Liu | E04H 4/0056 |
| 2002/0148194 | A1 * | 10/2002 | Miller | B28B 7/0008 52/741.4 |
| 2003/0212188 | A1 * | 11/2003 | Tanghe | B32B 17/04 524/494 |
| 2004/0078884 | A1 * | 4/2004 | Pugliese, Jr. | E04H 4/0037 4/506 |
| 2006/0175007 | A1 * | 8/2006 | Tanghe | B32B 17/04 156/308.4 |
| 2007/0144082 | A1 * | 6/2007 | Kantor | E04H 4/0043 52/169.7 |
| 2008/0005832 | A1 * | 1/2008 | Aguilar De Kegel | E04H 4/0018 4/506 |
| 2015/0089732 | A1 * | 4/2015 | Khamis | E04H 4/0037 4/506 |
| 2017/0138075 | A1 * | 5/2017 | Liu | E04H 4/0056 |
| 2018/0149342 | A1 * | 5/2018 | Lan | F21S 4/20 |

* cited by examiner

LIQUID CONTAINMENT POOL WALL USING POLYMER SHEETING

CROSS REFERENCE TO RELATED APPLICATIONS

This application claims benefit of priority from U.S. Provisional Patent Application No. 62/521,042 of Bernard J. Kulkaski, filed Jun. 16, 2017, entitled LIQUID CONTAINMENT VESSEL COMPONENT OR POOL WALL USING POLYMER SHEETING the entirety of which is incorporated herein by reference.

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

BACKGROUND OF THE INVENTION

Prior Art

The following is a tabulation of the prior art revealed during a patent search that may be relevant:

| Patent/App. Number | Kind Code | Issue/Publication Date | Patentee |
|---|---|---|---|
| RE29,936 | N/A | Mar. 20, 1979 | Arp |
| 3,975,874 | N/A | Aug. 24, 1976 | Witte etal. |
| 3,974,605 | N/A | Aug. 17, 1976 | Beatty etal. |
| 4,027,442 | N/A | Jun. 7, 1977 | Silverman |
| 4,047,340 | N/A | Sep. 13, 1977 | Witte et al. |
| 4,048,773 | N/A | Sep. 20, 1977 | Laven |
| 4,109,324 | N/A | Aug. 29, 1978 | Cornelius |
| 4,118,809 | N/A | Oct. 10, 1978 | Bertsch |
| 4,124,907 | N/A | Nov. 14, 1978 | Laven |
| 4,177,614 | N/A | Dec. 11, 1979 | Arp |
| 4,316,571 | N/A | Feb. 23, 1982 | Corna et al. |
| 4,464,802 | N/A | Aug. 14, 1984 | Glonek et al. |
| 4,566,141 | N/A | Jan. 28, 1986 | Mahoney |
| 5,010,603 | N/A | Apr. 30, 1991 | Hertzog |
| 5,791,099 | N/A | Aug. 11, 1998 | Duffy |
| 5,815,853 | N/A | Oct. 6, 1998 | Chase |
| 5,896,715 | N/A | Apr. 27, 1999 | Maupas |
| 5,991,940 | N/A | Nov. 30, 1999 | Fortier |
| 6,226,938 | B1 | May 8, 2001 | Hodak |
| 7,797,887 | B2 | Sep. 21, 2010 | Maupas |
| 8,702,030 | B1 | Apr. 22, 2014 | Gilham, Jr. |
| 8,850,773 | B2 | Oct. 7, 2014 | Cohen |

The present design relates to a liquid storage vessel or pool that uses a rigid polymeric material to provide an environmentally friendly, easily installable, corrosion proof containment wall having high tensile strength, burst strength, and creep resistance.

Liquid containment vessels or reservoirs such as out-of-ground swimming pools, water storage tanks, fish growing vessels and other similar containers are typically comprised of a structural frame, a flexible membrane liner and a rigid containment wall. Large quantities of water held in a tank place immense hydrostatic pressure on the containment vessel. Consequently, round or oval liquid containment walls lined with sheets of metal are typically used to distribute these pressures more evenly.

Pool containment walls are commonly manufactured using steel or aluminum sheet metal as discussed in U.S. Pat. No. 4,316,571 issued to Corna et al. and U.S. Pat. No. 4,566,141 issued to Mahoney. There has been a recent trend in the residential swimming pool market where salt is used to generate the chlorine required to sanitize a pool. This method leads to a high level of corrosion and deterioration of metallic pool components. While steel offers great strength, it corrodes quickly in fresh and salt water environments even when painted or galvanized. The slightest dent or scratch in the coating material will lead to eventual failure of the containment wall if left uncorrected.

Aluminum has also served as a desirable wall material due to its lighter weight and considerable tensile strength. This metal has a protective oxide layer, but even thick aluminum will corrode over time especially in salt water settings. Limestone, which is found in many soils and landscaping products, will also accelerate the corrosion process if it comes in contact with an aluminum containment vessel. Resin may be added to the steel or aluminum sheet metal to slow the corrosion process; but again, any scrapes, holes, dents or other damage to the wall surface will result in material failure if left uncorrected.

Many inventors have attempted to solve the corrosion problem by offering non-corrosive pre-fabricated foam or plastic panels that are assembled on-site and secured with interlocking geometries and various mechanical fasteners. (See e.g. U.S. Pat. No. 4,109,324 issued to Cornelius; U.S. Pat. No. 4,118,809 issued to Bertsch; U.S. Pat. No. 4,124,907 issued to Laven; and U.S. Pat. No. 4,177,614 issued to Arp.) A liner is then inserted into the pool cavity to retain a watertight seal and transfer the hydrostatic pressure to the pool wall, relying solely on the tensile strength of that wall to prevent the lower strength waterproof membrane from rupturing. The problem with these designs is that any rip or tear in the pool liner will result in a leak and may end in a catastrophic failure of the pool panels. The more seams and mechanical fasteners required to create the pool wall, the higher the likelihood of failure. Additionally, these plastics are susceptible to creep, and the panels are prone deflection and stretching over time while placed under load.

Other inventors have suggested spraying foam directly on an aluminum or steel pool wall to create a hardened surface that is impervious to corrosion (See U.S. Pat. No. 4,027,442 issued to Silverman.) This design requires an ultraviolet coating to prevent the sun from degrading the material. A compromised foam layer would be difficult to remove and would likely require the complete replacement of the costly pool wall.

In recent years, some swimming pool manufacturers have introduced a flexible waterproof member that serves as the containment wall, requiring no structural frame or liner. See U.S. Pat. No. 5,815,853 issued to Chase. The Chase patent claims a self-standing semi-rigid structure that relies on a polypropylene wall laminated to a flexible polypropylene mesh. The patent claims the lack of frame as an advantage; however, this design is of lower quality and strength and subject to stretching. The thin nature of the wall makes it susceptible to punctures and the lack of a frame limits the feasible pool depth. The increased creep in this material can be expected to create extensive distension of the pool wall over time and eventual failure. Any significant force applied to the vertical axis of the pool wall is likely to result in a failure or collapse of the pool wall.

BRIEF SUMMARY OF THE INVENTION

The present design addresses the problems discussed above by offering a lightweight, easily transported, simply installed liquid containment wall that may be made of recycled materials. The rigid polymeric sheet material used in this wall offers creep resistance, high tensile strength, increased burst strength and superior chemical resistance. It may be used alone, it may be layered or it may be used in combination with foils, meshes or other similar materials depending on the application and strength required.

Polymers are chemicals made of repeating units of carbon and hydrogen that create "chains." The strength of these polymers can be increased by "orienting" the chains within the material. In this process the polymer chains may be aligned in the direction of the load or in multiple directions. This increases the tensile strength and creep resistance of the material; larger loads can be transferred to these oriented chains as opposed to polymer materials that have not been oriented.

Thermoplastic polymers offer a light weight, high strength material that is resistant to both chemicals and creep and provides excellent thermal insulation which is desirable in heated pool applications. These materials may be made of recycled or virgin polyethylene, polypropylene, and polystyrene among other commonly used plastics. The orienting or stretching of polymers is well known in the art; the chains in these thermoplastic materials can be oriented by subjecting the polymer to strain while in a softened state. The preferred method involves reheating thermoplastic material to a specified temperature and then mechanically drawing an extrudate in either film, sheet, or fiber form as it exits the die and prior to solidification. The thermoplastic orientation can be adjusted to suit the load that will be applied, working much like the plurality of metal bands encircling a wine barrel; however, these bands or chains are embedded within the material itself.

Pool containment walls are generally constructed of steel or aluminum. The present design suggests the use of an oriented polymer such as polyethylene terephthalate (PET). Material creep may be reduced by selectively orienting the chains or by increasing the thickness of the plastic. Multiple layers of material will also offer increased strength, toughness and creep resistance. A material such as PET is impervious to corrosion and offers an economical and readily available material as it is often made from recycled plastics.

The polymer pool wall may be constructed of a single sheet or alternatively by arranging multiple smaller strips of oriented polymer and fusing them to form a sheet of the desired size. Ideally, these sheets are manufactured in coils allowing the user to achieve the desired wall thickness by unwinding the material and placing it along the pool base in concentric rings. Installing the pool wall in this way eliminates exposed seams and reduces the likelihood of leaks and failure.

A substantially oval or round standard support structure will be used in most applications. These support structures are typically constructed of a plurality of connected members that encase the pool wall, providing additional reinforcement and strength. Laminates or films may be added to the containment wall to address applications requiring increased burst strength, weather resistance, impact resistance, tear resistance, or aesthetic improvement.

REFERENCE NUMERALS

5 Containment Wall
10 Support Frame
15 Hydrostatic Pressure
20 Vessel Base
25 Oriented Polymer Sheeting
30 Laminate Material
35 Adhesive
40 Laminating Pressure Rolls
45 Finished Laminated Material
50 Corrugating Rolls
55 Finished Corrugated Material
60 Coiled Material for Installation
65 Exposed Seam
70 Pressure or Impact Point
75 Waterproof Liner
80 Oriented Polymer Reinforcing Bands

DETAILED DESCRIPTION OF THE INVENTION

Figure 1:
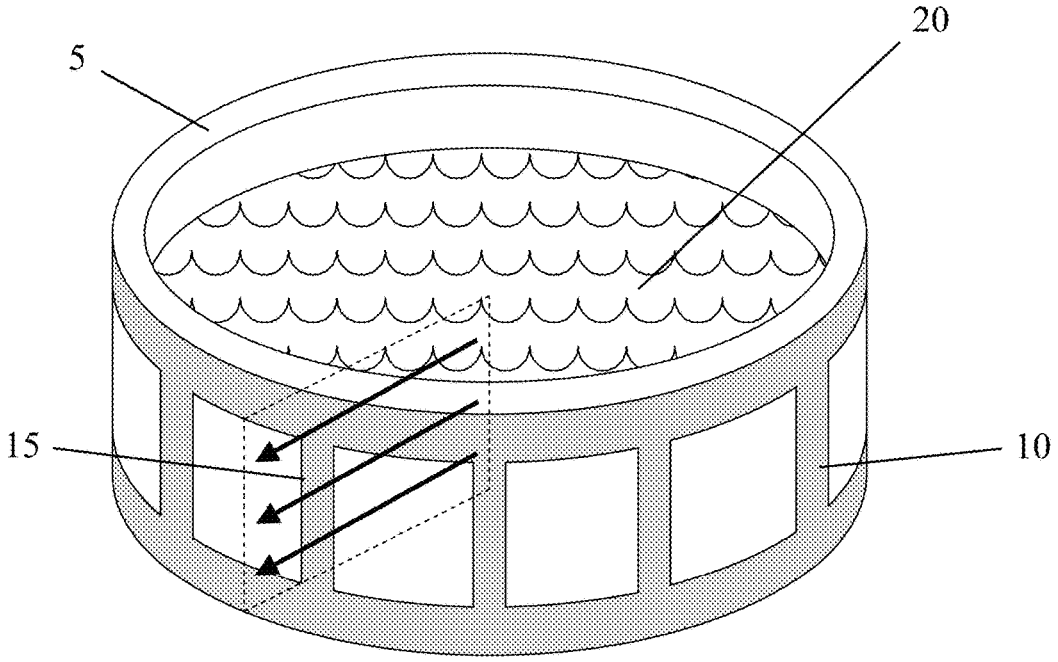
FIG. 1 provides a perspective view of a standard liquid containment vessel.

Referring now to FIG. 1, a typical pool or liquid containment vessel is comprised of a containment wall 5 reinforced by a support frame 10 and resting on a vessel base 20. A water-retaining liner or membrane (not shown) may be placed over the containment wall 5 and vessel base 20 to create a water tight barrier.

Liquid within the containment vessel exerts hydrostatic pressure 15 on the containment wall 5 as shown in FIG. 1; this pressure increases proportionally with the depth from the water surface. Pressure applied from motion within the pool such as diving, wave action and hydraulic shock can exceed the static water column pressure by several orders of magnitude. Consequently, the containment wall 5 must be made of a material having sufficient tensile strength, burst strength and creep resistance to accommodate these forces.

The preferred embodiment is comprised of a containment wall 5 constructed from at least one sheet of rigid oriented polymer 25 such as PET. The plurality of chains within the material may be oriented axially or biaxially through conventional manufacturing means. The oriented polymer should be mechanically drawn at a draw ratio between 2:1 and 6:1 to achieve the material properties required for this application. The direction of orientation may also be adjusted to achieve a material with the desired burst strength, creep resistance, tensile strength, and toughness. Thickness of the polymer sheet may also be modified to improve these material properties.

In another embodiment, single or multiple sheets or layers of non-oriented polymer pool wall may be used provided that the material has the requisite thickness, layering or positioning to withstand at least 1.25 times the static water column pressure exerted on a liquid containment vessel having a sixty inch depth.

Figure 2:
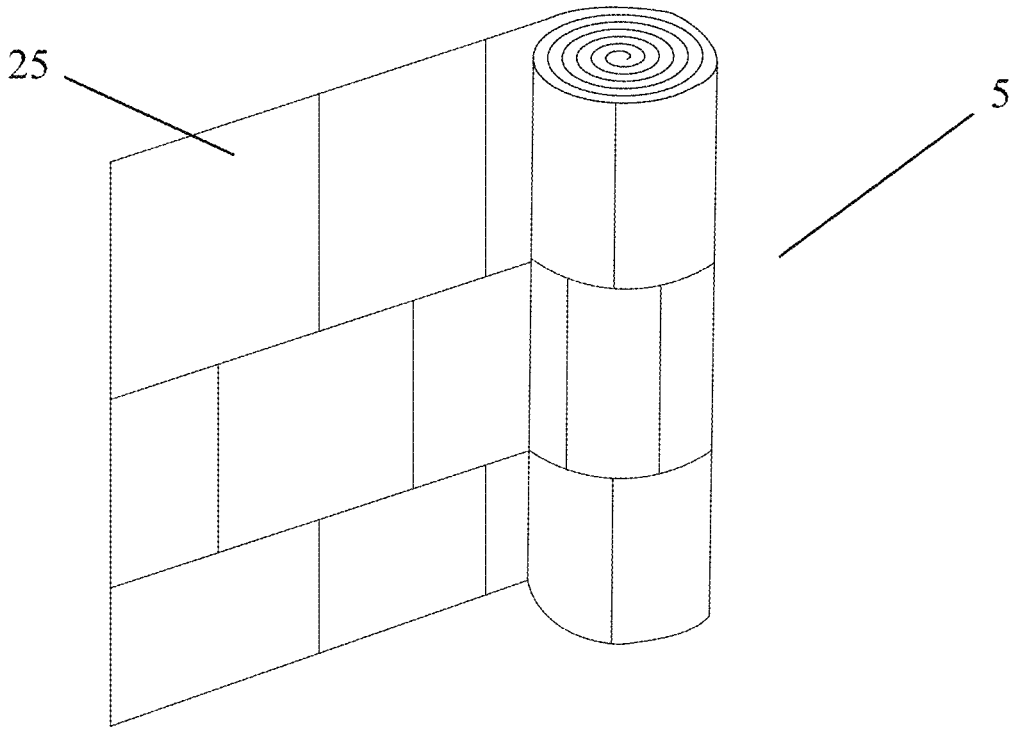
FIG. 2 provides a perspective view of the polymer pool wall in a coiled form that has been made from multiple strips of material.

The containment wall 5 may alternatively may be formed by arranging multiple smaller strips of oriented polymer 25 and fusing them to each other or to one or more plies of polymer to form a sheet of the desired size as shown in FIG. 2. These materials may be fused by any common manufacturing method such as sonic or laser welding.

In another embodiment, the containment wall 5 may be comprised of multiple smaller strips of oriented polymer 25 that are woven together to form a sheet of material.

Figure 3A:
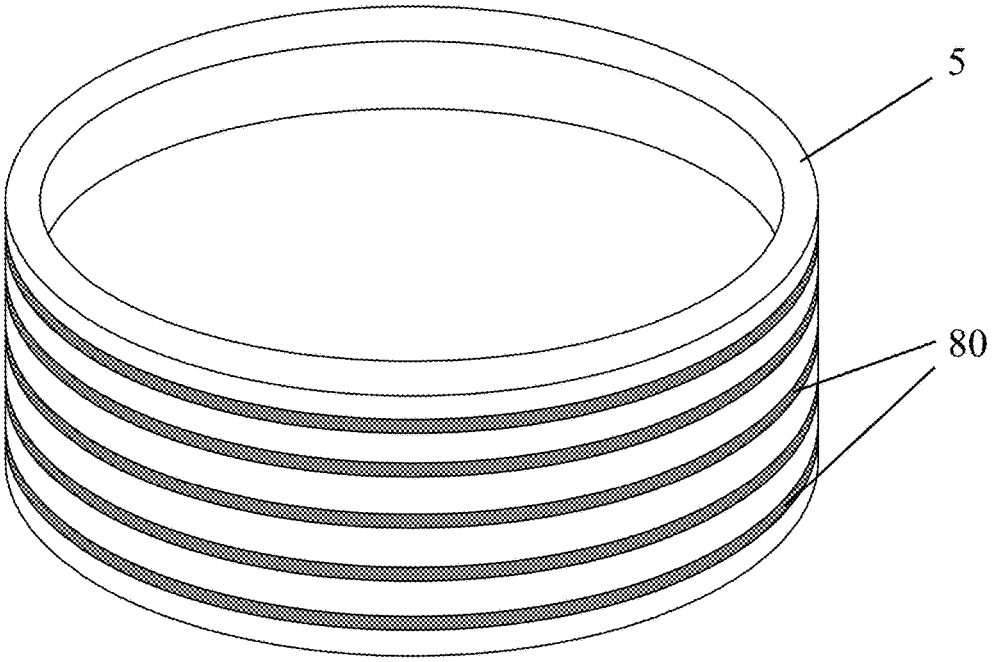
FIG. 3A provides a perspective view of a plurality of oriented polymer strips encircling the exterior surface of the containment wall to provide reinforcement.
Figure 3B:
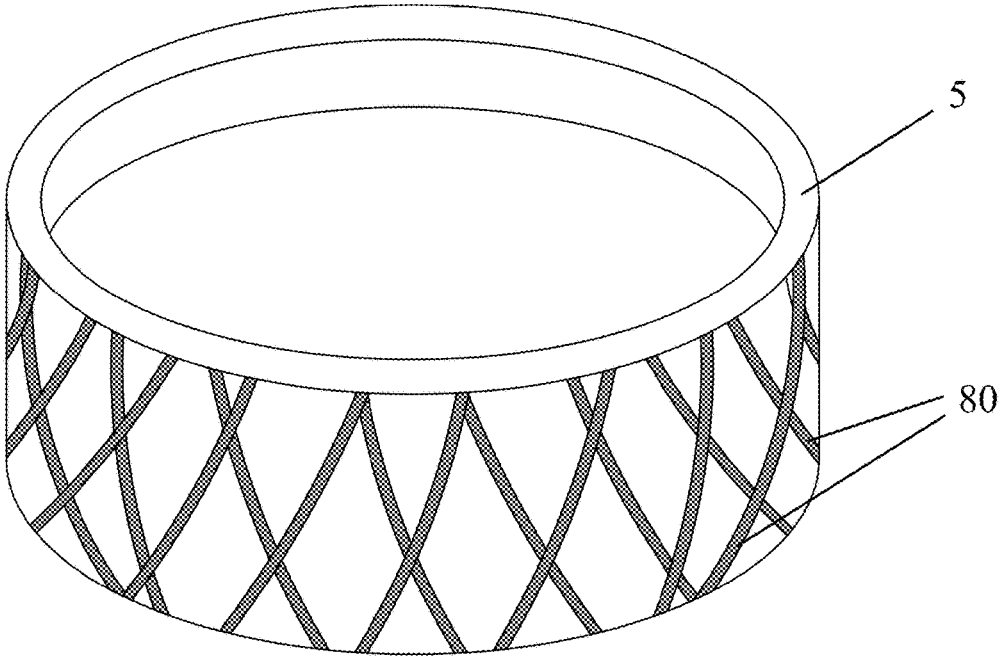
FIG. 3B provides a perspective view of a multiple layers of oriented polymer strips encircling the exterior surface of the containment wall on a bias to provide reinforcement.

In yet another embodiment, one or more oriented polymer reinforcing bands 80 may be added to the containment wall 5 as shown in FIGS. 3A and 3B. These bands may encircle the exterior of the containment wall 5 much like hoops on a barrel to increase the strength of the containment vessel. Alternatively, the bands 80 may be affixed to the interior of the containment wall 5. The bands 80 may be secured to the containment wall 5 by any number of means including but not limited to plastic welding techniques, adhesive application or the use of mechanical fasteners.

The bands 80, if used, will ideally be placed substantially parallel to one another and they may, but need not be, placed such that they are substantially parallel to the ground as shown in FIG. 3A. Multiple layers of banding may be used as shown in FIG. 3B and oriented in different directions. The bands 80 may also be woven together to further enhance their reinforcing strength. The spacing and widths of the bands 80 may vary based on the strength requirements for the particular application. The cross-sectional profile of the band may take any one of a number of shapes including but not limited to rectangular or bell-shaped profiles. It should be noted that the use of bands 80 may eliminate the need for a support frame 10 in applications requiring minimal strength provided that the material properties of the oriented polymer sheeting 25 and bands 80 are suited to the forces that will be exerted on the liquid containment vessel.

Figure 4A:
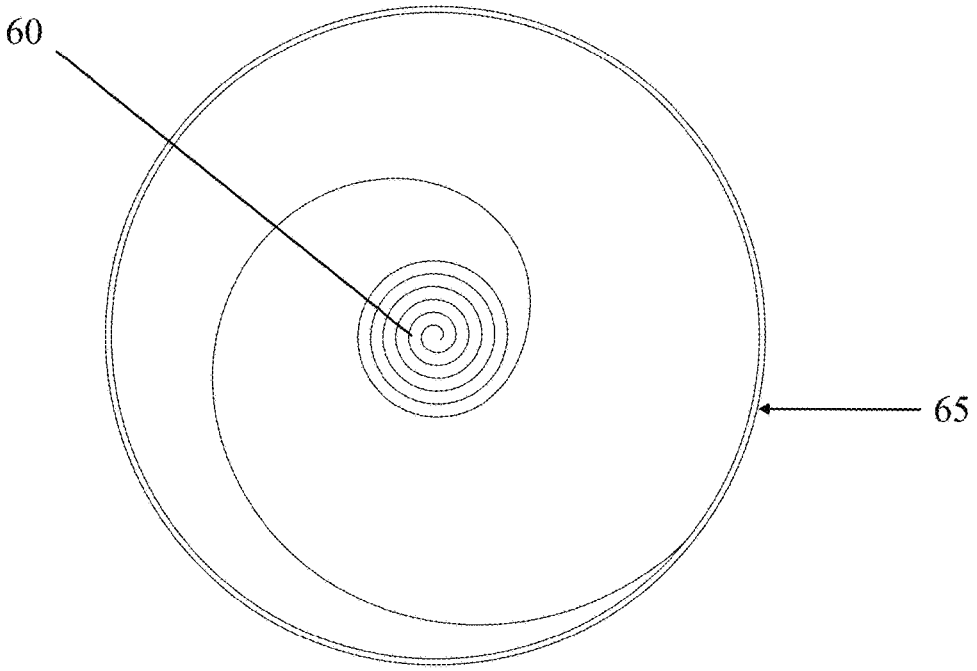
FIG. 4A provides a top view of the coiled polymer sheeting.
Figure 4B:
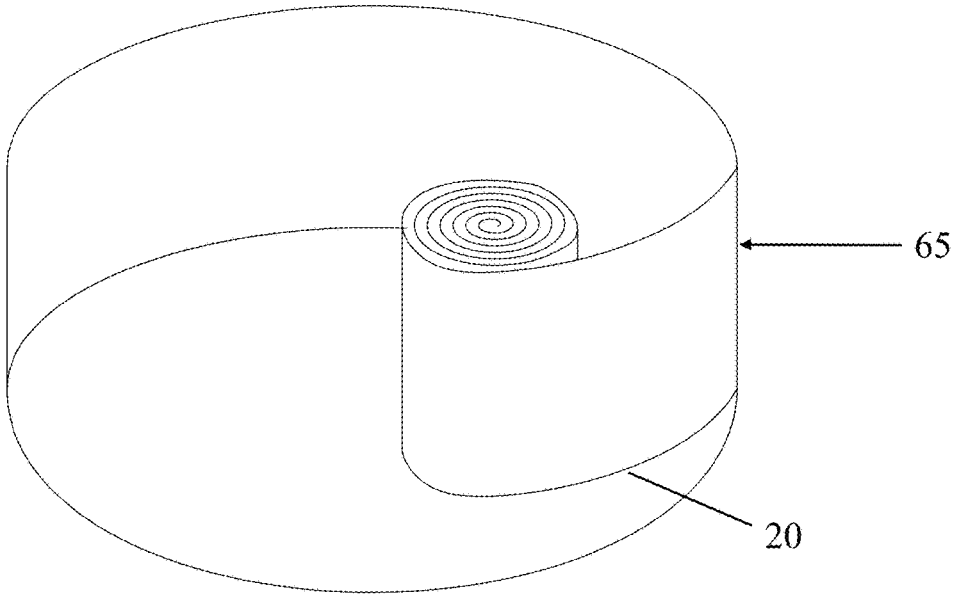
FIG. 4B provides a perspective view of a spiral installation of the polymer sheeting on the pool base FIG. 5A provides a side view of the lamination process FIG. 5B provides a side view of the final laminated product

Referring now to FIGS. 4A and 4B, the containment wall 5 is ideally manufactured in rolls or coils, allowing for easy installation. The containment wall 5 is unwound from the coil 60 and one or more overlapping sheets are placed the vessel base 20 to construct the containment wall 5. Concentric layering of containment wall 5 material will further strengthen the wall, offering increased impact resistance, creep resistance and durability. Because the seams are not exposed there are fewer points of failure in the containment wall 5. The single exposed seam 65 will be located on the exterior of the concentric layers. This seam may be fastened by any method or means that fixes the pool wall in a secure position.

Figure 5A:
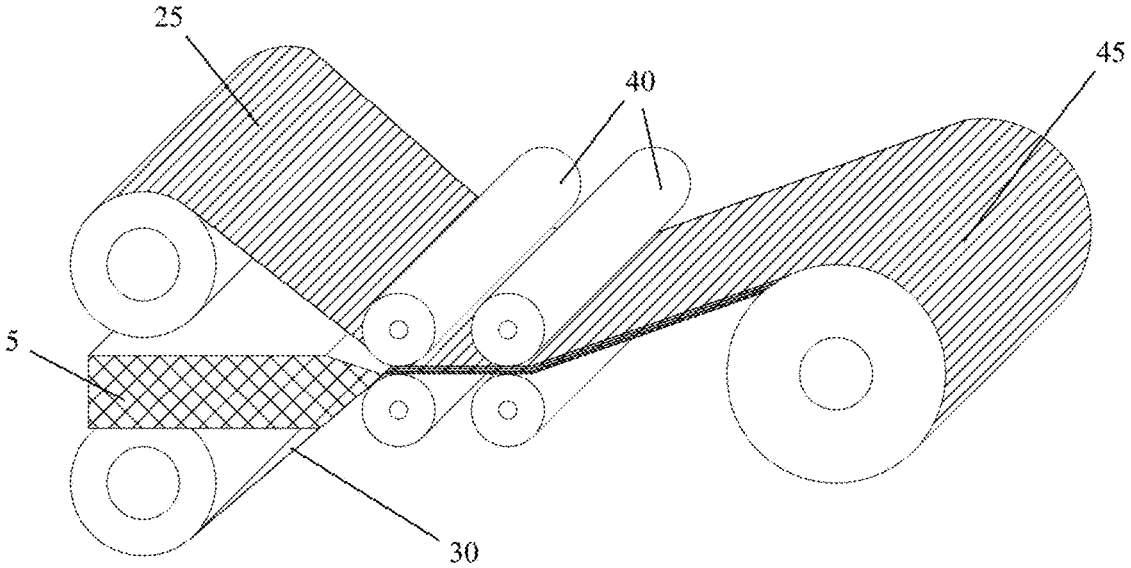
Figure 5B:
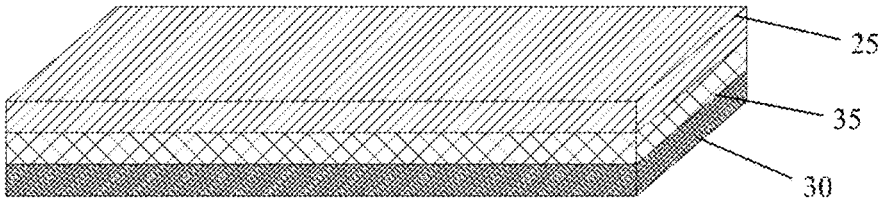

Polymeric sheet material may be used alone or in combination with a secondary sheet material create the containment wall 5 to enhance UV resistance, creep resistance, impact resistance and tensile strength. Additionally, decorative coatings, ink, paint, varnish or printed webbing may be applied to enhance the appearance and durability of the pool wall. The polymeric sheet material may be laminated or affixed to one or more layers of metallic foil, mesh, or plastic. Adhesive 35 may be introduced between the polymeric sheet material 25 and the laminate material 30 and be routed through pressure rolls 40 to create a finished laminate material 45 as shown in FIGS. 5A and 5B. The addition of one or more of these layers will increase the tensile strength and impact resistance of the pool wall. Similar means may be used to adhere multiple layers of polymer sheeting to enhance the strength of the containment wall 5.

Figure 6A:
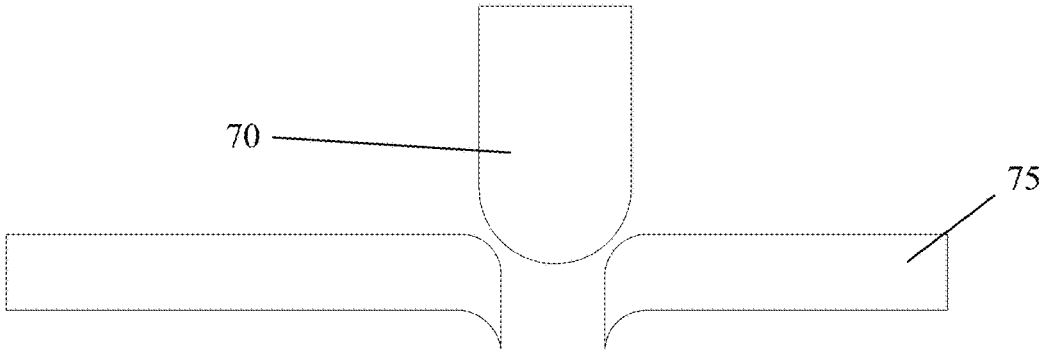
FIG. 6A is a side view of a pressure or impact point on a non-oriented polymer sheet
Figure 6B:
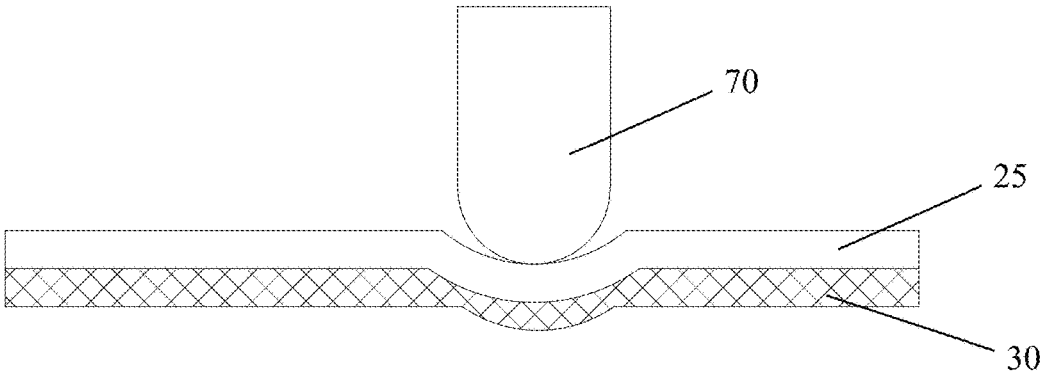
FIG. 6B is a side view of a pressure or impact point on an oriented and laminated polymer sheet FIG. 7 provides a perspective view of the corrugation process

Mesh, if used, may be woven or non-woven and made out of any suitable material such as stainless steel, fiberglass, polymers, basalt fiber or carbon fiber. Laminated sheets of this nature are known to enhance material properties and will protect the containment wall 5 from tearing, ruptures, bursting and collapse. See FIG. 6A illustrating a pressure or impact point 70 penetrating a polymer sheet 75. FIG. 6B depicts oriented polymer sheeting 25 having impact resistant sufficient to prevent the pressure or impact point 70 from piercing the laminate material 30.

Figure 7:
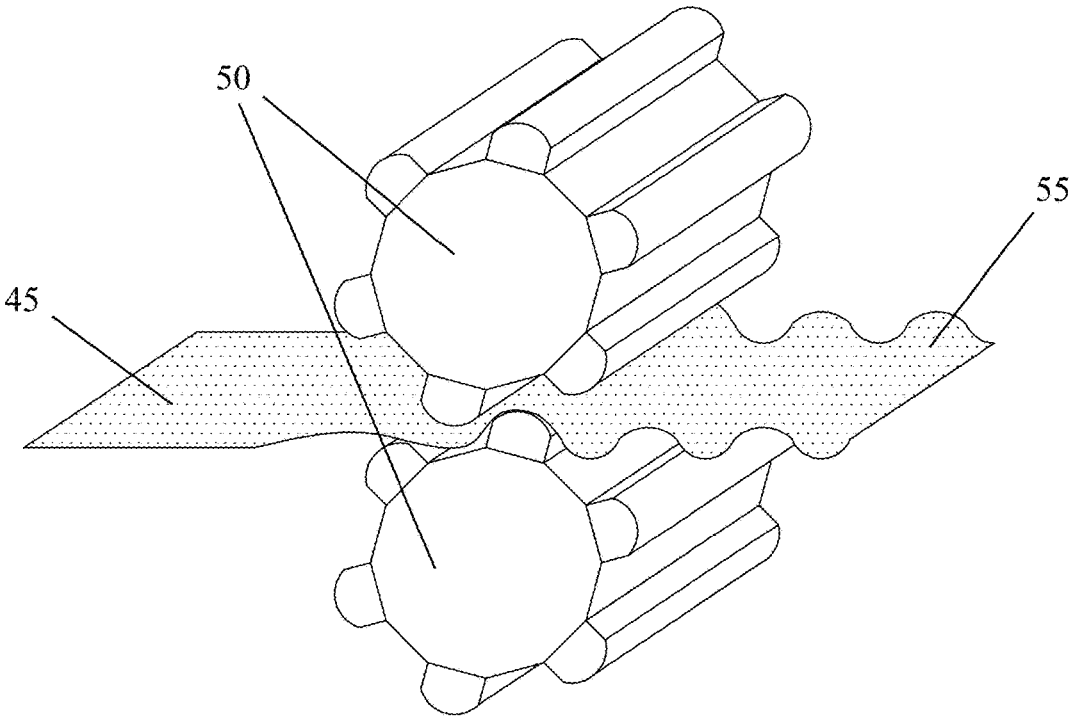

Polymer or laminated polymer sheets may be corrugated using corrugating rolls 50 having a wave-like, square-edge, semi-circular or similar alternating shape, provided that such corrugations do not create an accordion effect on the material. See FIG. 7. Corrugations are commonly used in steel and are known for increasing the compressive strength of the base sheet material. Corrugations will similarly increase the tensile strength of polymer and laminated polymer sheets and will provide dimension to the sheet thickness, increasing its stiffness and allowing for easier installation. Ideally the corrugations in the material will be uniform and evenly spaced, allowing concentric layers of the pool wall to lock into one another. In addition, impact resistance will increase, the likelihood of warpage will decrease and a more durable containment wall will result in a corrugated containment wall 55.

The polymeric sheet material used to create the containment wall 5 can be made using any one of a number of known plastic materials having sufficient strength to withstand at least 1.25 times the static water column pressure exerted on a liquid containment vessel having a sixty inch depth. The properties of PET make it a suitable plastic for use in this application. Because it is often made of recycled plastics, it is readily available, economical, and environmentally friendly; however, it should be recognized that a number of plastic materials may be used.

While the above description contains many specifics, these should be considered exemplifications of one or more embodiments rather than limitations on the scope of the invention. As previously discussed, many variations are possible and the scope of the invention should not be restricted by the examples illustrated herein.

The invention claimed is:

1. A liquid containment vessel comprising:

(a) a vessel base having a perimeter;

(b) a containment wall composed of a rigid polymeric sheet material and having an exposed exterior surface and an interior surface, said containment wall being secured about an entirety of the perimeter of the vessel base to form the liquid containment vessel;

(c) a water-retaining liner disposed within the containment wall; and (d) a support frame, said support frame encasing and reinforcing the exposed exterior surface of the containment wall, wherein one or more bands of oriented polymer encircle the containment wall on the exposed exterior surface or on the interior surface.

2. The liquid containment vessel of claim 1, wherein said rigid polymeric sheet material is oriented polymer.

3. The liquid containment vessel of claim 1, wherein said rigid polymeric sheet material is made from oriented polyethylene terephthalate (PET).

4. The liquid containment vessel of claim 1, wherein said rigid polymeric sheet material is made from oriented polystyrene.

5. The liquid containment vessel of claim 1, wherein said rigid polymeric sheet material is made from oriented polypropylene.

6. The liquid containment vessel of claim 1, wherein said rigid polymeric sheet material is made from oriented polyethylene.

7. The liquid containment vessel of claim 1, wherein said rigid polymeric sheet material is corrugated.

8. The liquid containment vessel of claim 1, wherein said rigid polymeric sheet material is installed in concentric layers within the vessel base.

9. The liquid containment vessel of claim 1, wherein said rigid polymeric sheet material is installed in multiple single layers within the vessel base.

10. The liquid containment vessel of claim 1, wherein said containment wall is comprised of multiple plies of polymeric material that have been laminated to form the rigid polymeric sheet material.

11. The liquid containment vessel of claim 1, wherein said containment wall is comprised of multiple strips of polymeric material that have been laminated to form the rigid polymeric sheet material.

12. The liquid containment vessel of claim 1, wherein said containment wall is comprised of multiple strips of polymeric material that have been woven to form the rigid polymeric sheet material.

13. The liquid containment vessel of claim 1, wherein the containment wall is coated with a material selected from the group consisting of ink, paint, varnish or decorative webbing.

14. The liquid containment vessel of claim 1, wherein one or more layers of foil are laminated to the rigid polymeric sheet material.

15. The liquid containment vessel of claim 1, wherein one or more layers of woven or non-woven mesh are laminated to the rigid polymeric sheet material, the mesh selected from the group consisting of stainless steel, fiberglass, polymer, basalt fiber or carbon fiber.

* * * * *